US007374181B1

(12) United States Patent
Wu

(10) Patent No.: US 7,374,181 B1
(45) Date of Patent: May 20, 2008

(54) MECHANIC'S CREEPER WITH PULL-OUT EXPANSION

(75) Inventor: Qing Yan Wu, Tai-Shan (CN)

(73) Assignee: Shinn Fu Corporation, Taipei (TW)

( * ) Notice: Subject to any disclaimer, the term of this patent is extended or adjusted under 35 U.S.C. 154(b) by 19 days.

(21) Appl. No.: 11/635,668

(22) Filed: Dec. 8, 2006

(51) Int. Cl.
*B25H 5/00* (2006.01)

(52) U.S. Cl. ..... 280/32.6; 280/32.5; 280/638; 280/35

(58) Field of Classification Search ..... 280/32.5, 280/32.6, 35, 79.2, 79.11, 638, 87.01, 87.021, 280/87.041, 87.042, 87.05
See application file for complete search history.

(56) References Cited

U.S. PATENT DOCUMENTS 2,717,159 A * 9/1955 Thomas ..... 280/845
5,857,683 A * 1/1999 Auel ..... 280/32.6
5,863,053 A * 1/1999 Berry ..... 280/32.6
6,199,877 B1 * 3/2001 Shockley ..... 280/32.6
6,398,234 B1 * 6/2002 Brown ..... 280/32.6
2005/0023780 A1 * 2/2005 Liu ..... 280/32.6
2007/0080510 A1 * 4/2007 Ji ..... 280/32.6

* cited by examiner

*Primary Examiner*—Christopher Ellis
*Assistant Examiner*—Vaughn T Coolman
(74) *Attorney, Agent, or Firm*—Bacon & Thomas, PLLC

(57) ABSTRACT

A pull-out recliner is disclosed to include a rear recliner frame unit equipped with a front pair of wheel assemblies and a rear pair of wheel assemblies, a front recliner frame unit coupled to the rear recliner frame unit and movable in and out of the rear recliner frame unit between the received position and the extended position, a rear cushion fixedly mounted on the rear recliner frame unit, a front cushion, and a movable rack affixed to the front side of the front cushion and pivoted to the front side of the front recliner frame unit such that the front cushion is kept in flush with the rear cushion when the pull-out recliner is extended out, or stacked on the rear cushion when the front recliner frame unit is received in the rear recliner frame unit.

6 Claims, 6 Drawing Sheets

MECHANIC'S CREEPER WITH PULL-OUT EXPANSION

BACKGROUND OF THE INVENTION (a) Field of the Invention

The present invention relates to a recliner, typically referred to as mechanic's creeper, and more particularly, to an expandable pull-out creeper practical for use during a car repair work that has two recliner cushions sliding one under the other and conveniently receivable to save storage space.

(b) Description of the Prior Art

A conventional creeper for use during repair work is a mobile board on which the mechanic lies when examining or repairing the chassis of a car or the bottom parts of a machine. A creeper for this purpose generally comprises a narrow elongate recliner body equipped with wheels. Because conventional creepers for this purpose are commonly not collapsible, they occupy much storage space when not in use. Therefore, it is inconvenient to keep, transport, and store this kind of creepers.

SUMMARY OF THE INVENTION

The present invention has been accomplished under the circumstances in view. According to one aspect of the present invention, the pull-out creeper comprises a rear recliner frame unit equipped with a front pair of wheel assemblies and a rear pair of wheel assemblies and having two side frame tubes, a front recliner frame unit, which has two side frame tubes respectively slidably inserted into the side frame tubes of the rear recliner frame unit such that the front recliner frame unit is movable in and out of the rear recliner frame unit between the received position and the extended position, a rear cushion fixedly mounted on the rear recliner frame unit, a front cushion, and a movable bracket affixed to the front side of the front cushion and pivoted to the front side of the front recliner frame unit. The front cushion is supported on the front recliner frame unit and a part of the rear recliner frame unit and kept in flush with the rear cushion when the pull-out recliner is extended out. The rear side of the front cushion is liftable so that the front cushion can be stacked on the rear cushion when the front recliner frame unit is received in the rear recliner frame unit to save storage space.

According to another aspect of the present invention, the side frame tubes of the front recliner frame unit each have a rear end respectively mounted with a respective retaining spring member for locking the side frame tubes of the front recliner frame unit to the rear recliner frame unit when the front recliner frame unit is moved out of the rear recliner frame unit from the received position to the extended position.

DETAILED DESCRIPTION OF THE PREFERRED EMBODIMENTS

Figure 1:
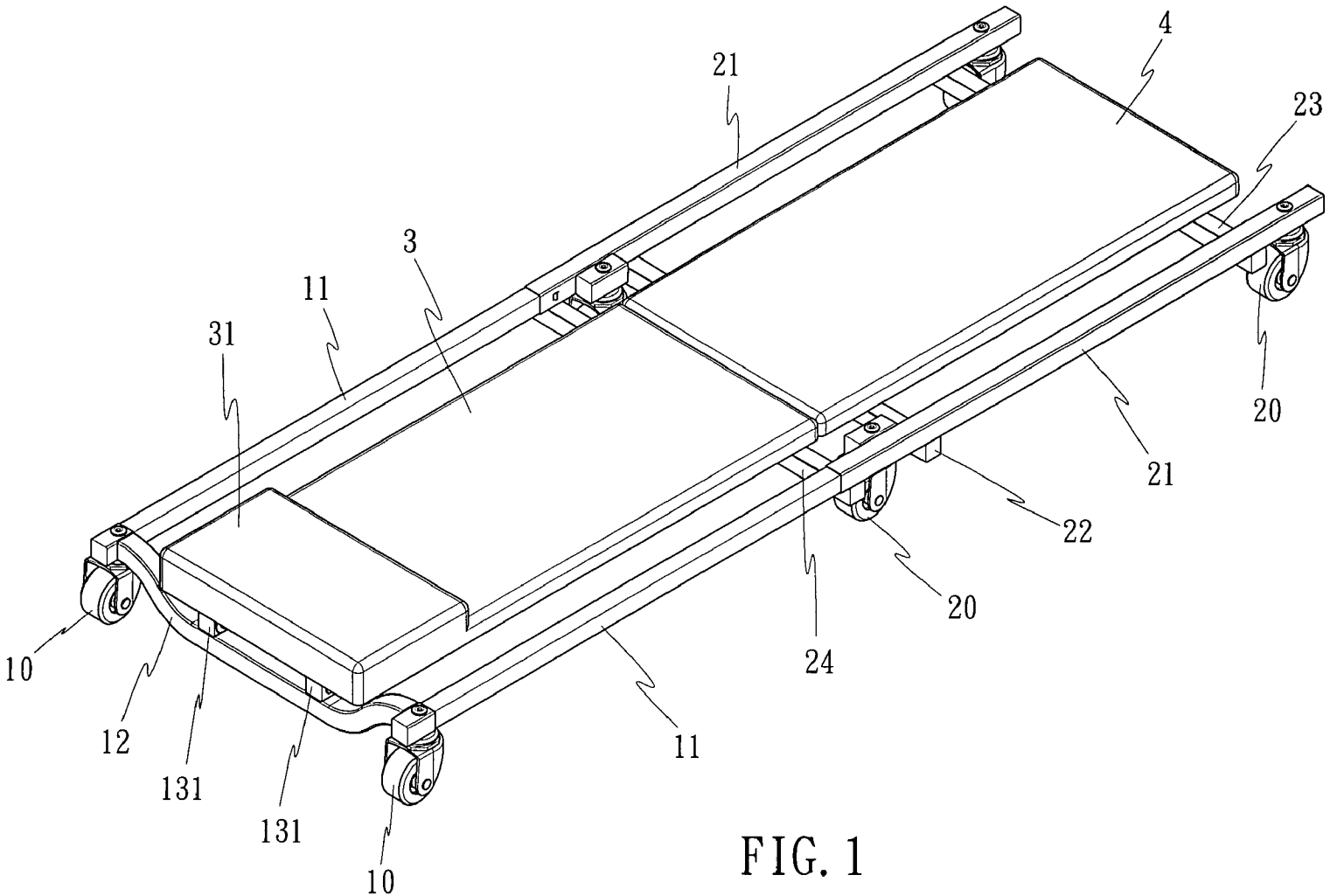
FIG. 1 is an oblique top elevation of the extended out status of a pull-out creeper according to the present invention.
Figure 2:
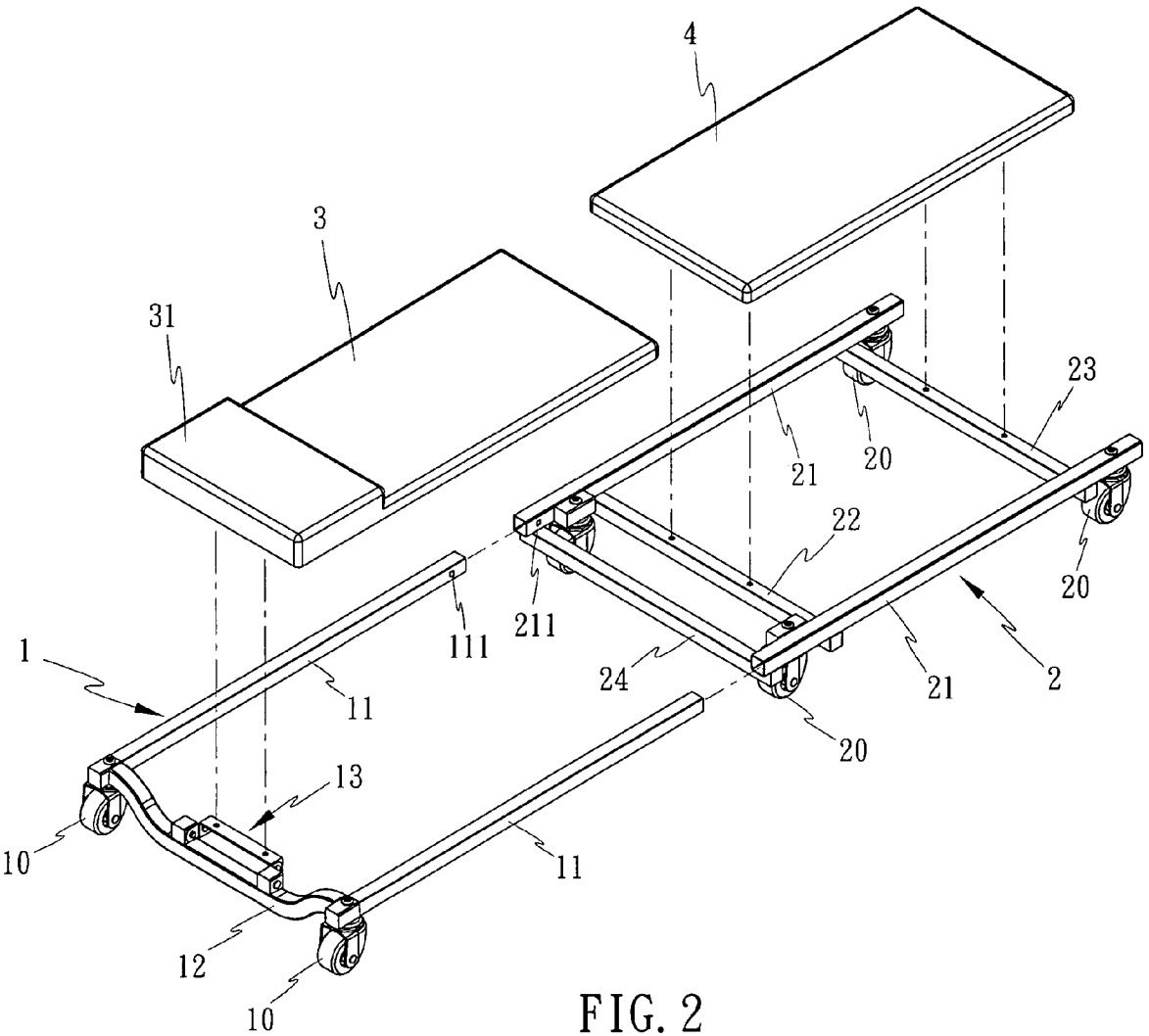
FIG. 2 is an exploded view of the pull-out creeper according to the present invention.

Referring to FIGS. 1 and 2, a pull-out creeper in accordance with the present invention is practical for use in car repair work for supporting the user in a lying position under the bottom side of a car or machine for performing repair work. The pull-out creeper comprises a front recliner frame unit 1, a rear recliner frame unit 2, a front cushion 3, and a rear cushion 4.

Figure 3:
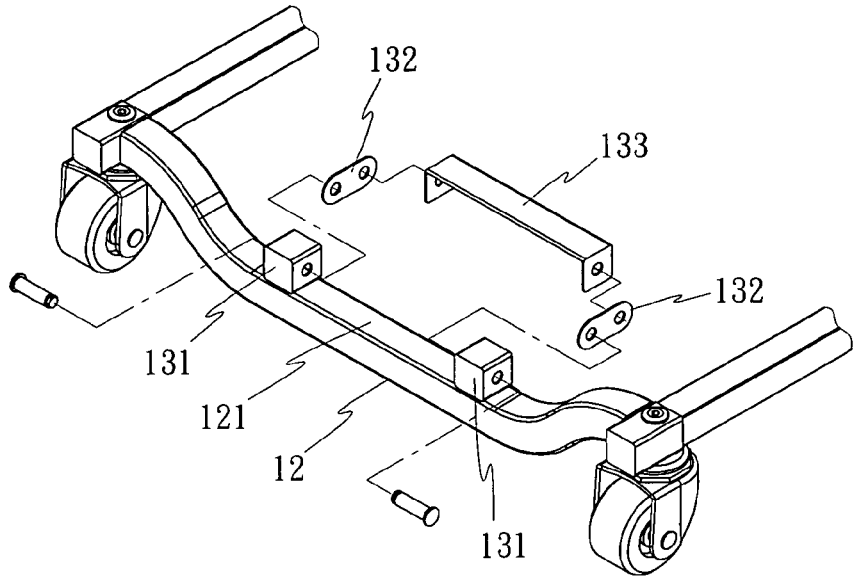
FIG. 3 is an exploded view of a part of the front recliner frame unit of the pull-out creeper according to the present invention, showing the structure of the movable bracket.
Figure 4:
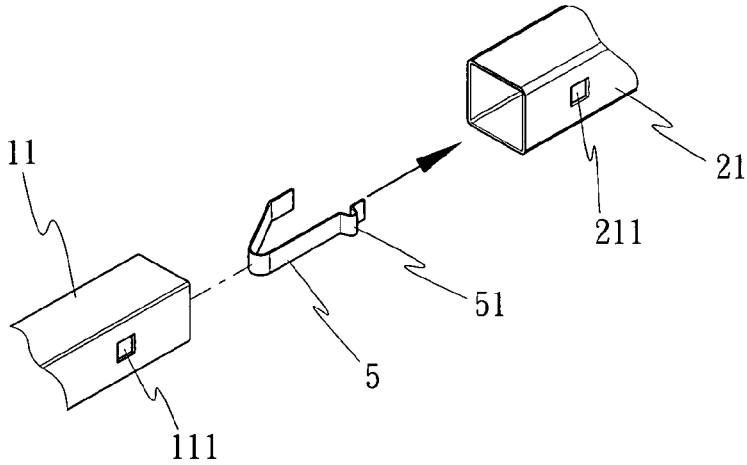
FIG. 4 is an exploded view of a part of the present invention, showing the connection arrangement between one side frame tube of the front recliner frame unit and the associating side frame tube of the rear recliner frame unit.

The front recliner frame unit 1 comprises two side frame tubes 11 longitudinally arranged in parallel, a connecting bar 12 transversely connected between the front ends of the side frame tubes 11, two wheel assemblies 10 respectively pivotally mounted on the front ends of the side frame tubes 11 at the bottom side, and a movable bracket 13 coupled to the connecting bar 12. The connecting bar 12 has a recessed middle part 121. As shown in FIGS. 3 and 4, the movable bracket 13 comprises two locating blocks 131 fixedly mounted on the recessed middle part 121 of the connecting bar 12, a support frame 133, and two links 132 respectively pivotally connected between the locating blocks 131 and the two distal ends of the support frame 133. Thus, the support frame 133 can be moved relative to the locating blocks 131 between two elevational positions and maintain its horizontal position.

The rear recliner frame unit 2 comprises two side frame tubes 21, a first connecting bar 22 transversely connected between the two side frame tubes 21 near the rear ends of the side frame tubes 21, a second connecting bar 23 transversely connected between the two side frame tubes 21 near the front ends of the side frame tubes 21, a reinforcing bar 24 transversely connected between the front ends of the side frame tubes 21, and two pairs of wheel assemblies 20 respectively pivotally mounted on the front and rear ends of the side frame tubes 21 at the bottom side. The side frame tubes 21 of the rear recliner frame unit 2 have an inner diameter fitting the outer diameter of the side frame tubes 11 of the front recliner frame unit 1. The side frame tubes 11 of the front recliner frame unit 1 are respectively slidably inserted into the side frame tubes 21 of the rear recliner frame unit 2.

The front cushion 3 is preferably covered with a soft covering, having a width slightly smaller than the distance between the two side frame tubes 11 of the front recliner frame unit 1. The front cushion 3 is fixedly fastened with its front side to the top wall of the support frame 133 of the movable bracket 13. The rear side of the front cushion 3 is the free end supported on the reinforcing bar 24 of the rear recliner frame unit 2 and freely liftable.

The rear cushion 4 is fixedly fastened to the first connecting bar 22 and second connecting bar 23 of the rear recliner frame unit 2 at the top.

As indicated above, the front cushion 3 and the rear cushion 4 are respectively affixed to the front recliner frame unit 1 and the rear recliner frame unit 2; the movable bracket 13 is movable between two elevational positions; the side frame tubes 11 of the front recliner frame unit 1 are movable in and out of the side frame tubes 21 of the rear recliner frame unit 2. Therefore, the user can pull the front recliner frame unit 1 out of the rear recliner frame unit 2 to fully extend the creeper. Alternatively, the user can lift the front cushion 3, and then move the front recliner frame unit 1 into the rear recliner frame unit 2 to have the rear cushion 4 be received under the front cushion 3, thereby saving storage space.

Figure 5:
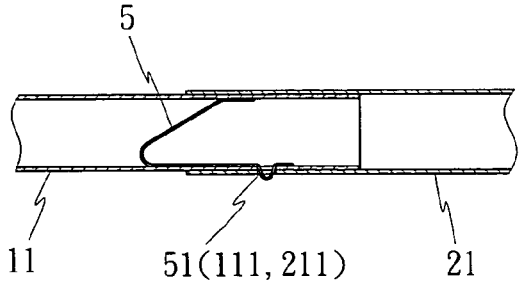
FIG. 5 is a sectional assembly view of FIG. 4.

Referring to FIGS. 4 and 5, the side frame tubes 11 of the front recliner frame unit 1 each have a retaining hole 111 near the rear end, and a retaining spring member 5 fixedly mounted in the rear end. The retaining spring member 5 has a retaining portion 51 projecting out of the retaining hole 111. The side frame tubes 21 of the rear recliner frame unit 2 each have a retaining hole 211 near the front end corresponding to the retaining hole 111 of the associating side frame tube 11 of the front recliner frame unit 1. When the front recliner frame unit 1 is pulled out of the rear recliner frame unit 2, the retaining portions 51 of the retaining spring members 5 are respectively forced into the retaining holes 211 of the side frame tubes 21 of the rear recliner frame unit 2, thereby locking the front recliner frame unit 1 and the rear recliner frame unit 2. When pressed the retaining portions 51 of the retaining spring members 5 inwards to disengage the retaining portions 51 of the retaining spring members 5 from the retaining holes 211 of the side frame tubes 21 of the rear recliner frame unit 2, the user can then move the front recliner frame unit 1 relative to the rear recliner frame unit 2 between the extended position or the received position.

Figure 6:
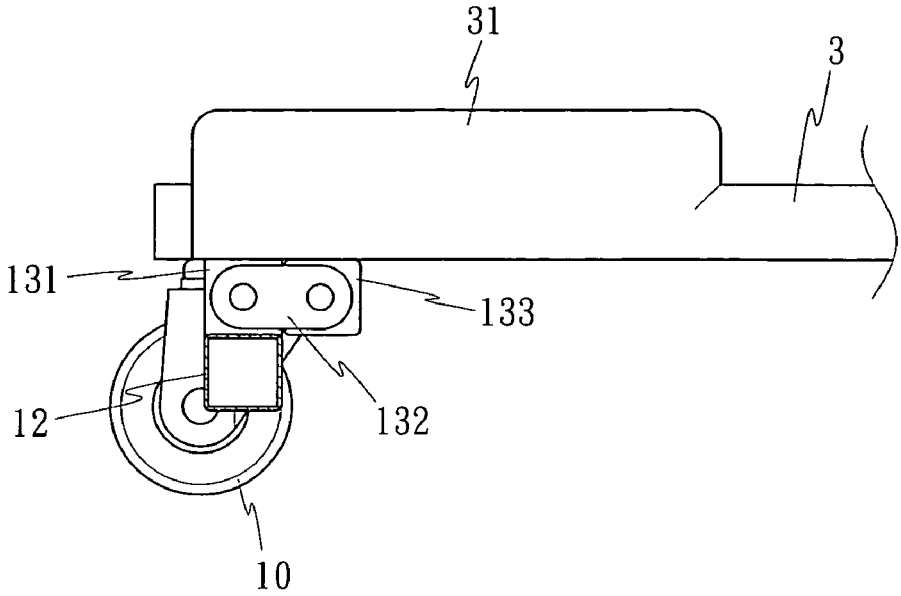
FIG. 6 is a side plain view of the front part of the present invention, showing the status of the movable bracket during the extended-out status of the pull-out creeper.
Figure 7:
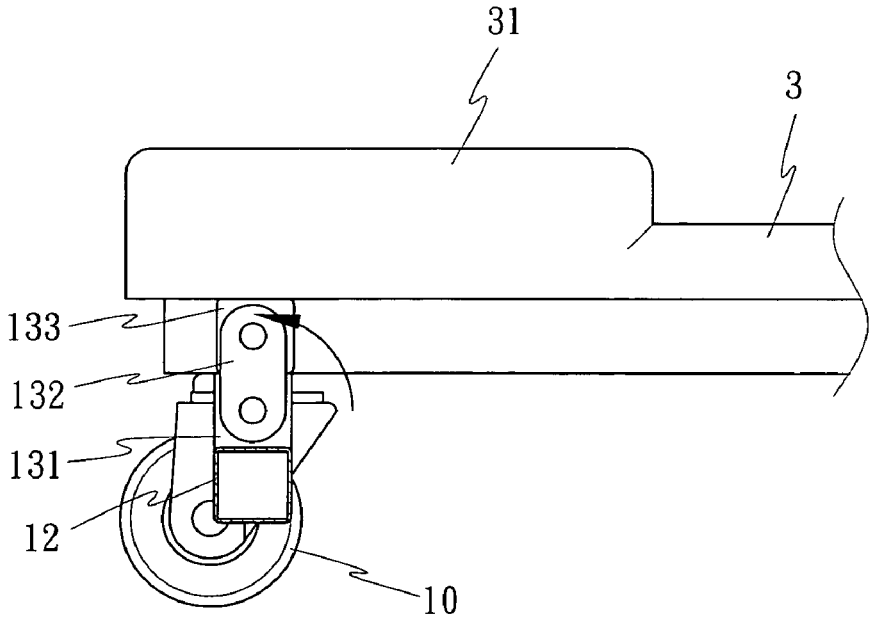
FIG. 7 is similar to FIG. 6 but showing the movable bracket turned from a lower elevational position to a higher elevational position.
Figure 8:
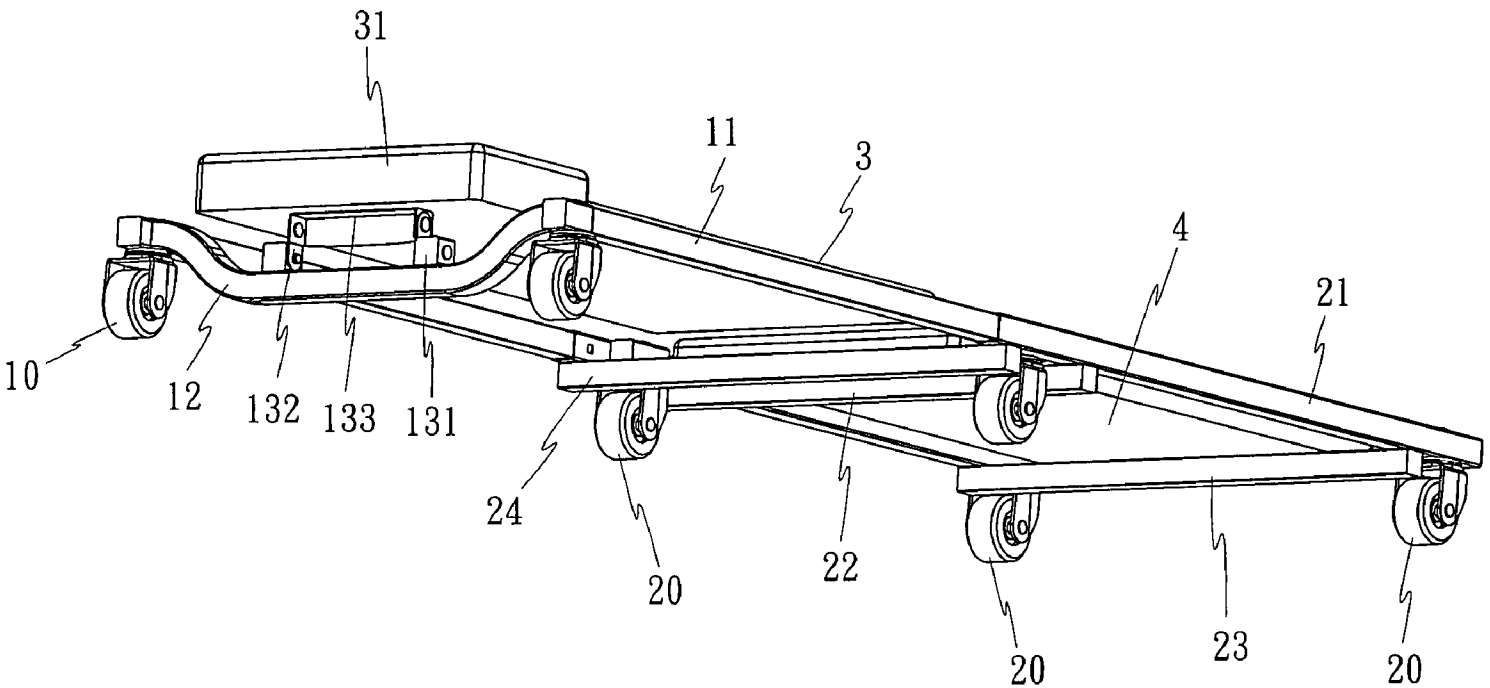
FIG. 8 is an oblique bottom elevation of the present invention, showing the extended out status of the pull-out creeper.
Figure 9:
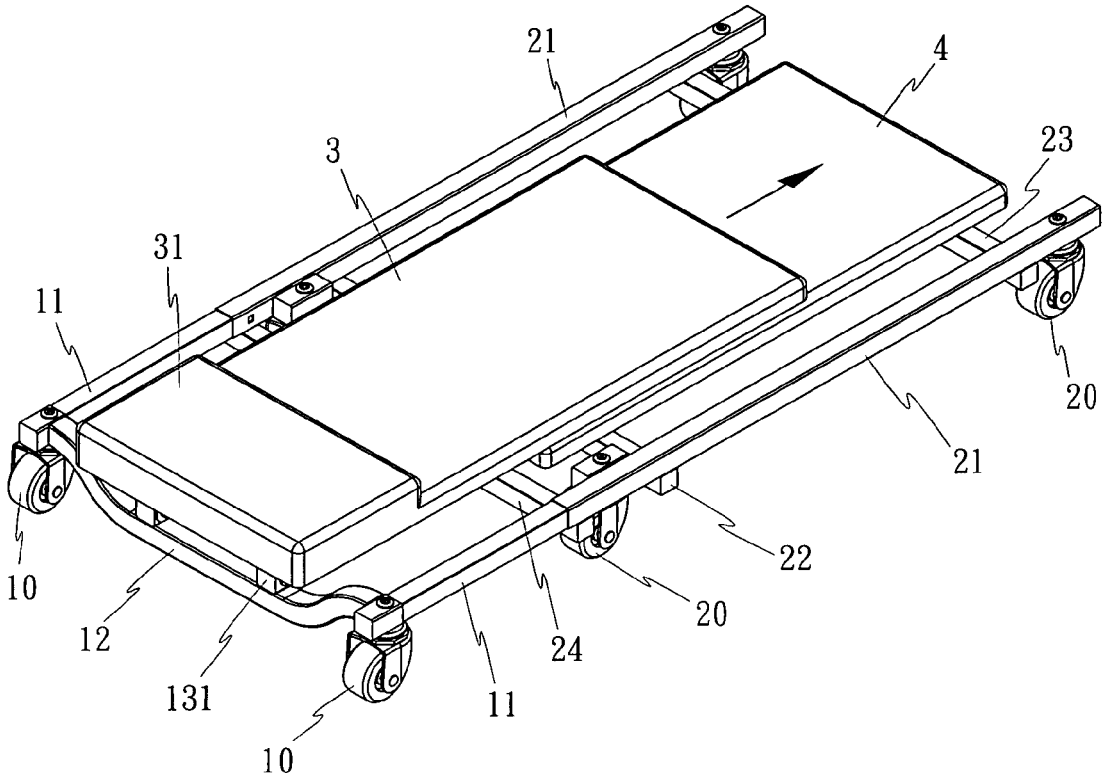
FIG. 9 is a schematic drawing showing the front recliner frame unit moved toward the rear recliner frame unit.

When the pull-out recliner is extended, the movable bracket 13 is moved from the upper elevation position to the lower elevation position as shown in FIG. 6.

Figure 10:
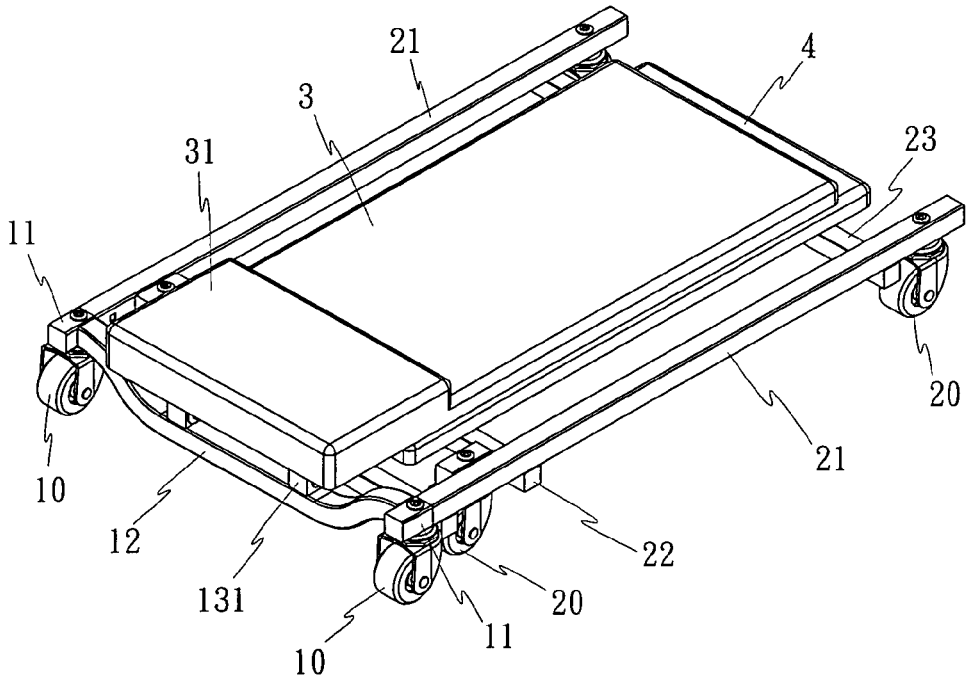
FIG. 10 is an oblique top elevation of the present invention, showing the received status of the pull-out creeper.

Referring to FIGS. 7~10, when creeper is returned to its received position, the support frame 133 of the movable bracket 13 is lifted from the lower elevation position to the upper elevation position (see FIG. 7), and the lift the rear side of the front cushion 3 (see FIG. 8), permitting the front recliner frame unit 1 to be pushed over the rear recliner frame unit 2 and the rear cushion 4 thereof (see FIG. 9) and to further have the front cushion 3 and the rear cushion 4 be received together in a stack (see FIG. 10).

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pull-out mechanic's creeper comprising:

a rear recliner frame unit, said rear recliner frame unit comprising two side frame tubes, the side frame tubes of said rear recliner frame unit each having a front end and a rear end, a first connecting bar and a second connecting bar respectively and transversely connected between the two side frame tubes of said rear recliner frame unit near the front and rear ends of the side frame tubes of said rear recliner frame unit, a reinforcing bar transversely connected between the front ends of the side frame tubes, and two pairs of wheel assemblies respectively pivotally mounted on the front and rear ends of the side frame tubes of said rear recliner frame unit at a bottom side;

a front recliner frame unit, said front recliner frame unit comprising two side frame tubes, the side frame tubes of said front recliner frame unit each having a front end and a rear end, the rear ends of the side frame tubes of said front recliner frame unit being respectively slidably inserted into the front ends of the side frame tubes of said rear recliner frame unit such that said front recliner frame unit is coupled to said rear recliner frame unit and movable relative to said rear recliner frame unit between an extended position and a received position, a connecting bar transversely connected between the front ends of the side frame tubes of said front recliner frame unit, two wheel assemblies respectively pivotally mounted on the front ends of the side frame tubes of said front recliner frame unit at a bottom side, and a movable bracket pivoted to the connecting bar of said front recliner frame unit;

a front cushion mounted on said front recliner frame unit, said front cushion having a front side fixedly fastened to said movable bracket and a rear side freely supported on said reinforcing bar of said rear recliner frame unit; and a rear cushion fixedly fastened to the first connecting bar and second connecting bar of said rear recliner frame unit.

2. The pull-out mechanic's creeper as claimed in claim 1, wherein the connecting bar of said front recliner frame unit has a recessed middle part; said movable bracket is fastened to the recessed middle part of the connecting bar of said front recliner frame unit.

3. The pull-out mechanic's creeper as claimed in claim 2, wherein said movable bracket comprises two locating blocks fixedly mounted on the recessed middle part of the connecting bar of said front recliner frame unit, a support frame, and two links respectively pivotally connected between said locating blocks and two distal ends of said support frame.

4. The pull-out mechanic's creeper as claimed in claim 1, wherein said front cushion has a width smaller than the distance between the two side frame tubes of said front recliner frame unit.

5. A pull-out mechanic's creeper comprising:

a rear recliner frame unit, said rear recliner frame unit comprising two side frame tubes, the side frame tubes of said rear recliner frame unit each having a front end and a rear end, a first connecting bar and a second connecting bar respectively and transversely connected between the two side frame tubes of said rear recliner frame unit near the front and rear ends of the side frame tubes of said rear recliner frame unit, a reinforcing bar transversely connected between the front ends of the side frame tubes, and two pairs of wheel assemblies respectively pivotally mounted on the front and rear ends of the side frame tubes of said rear recliner frame unit at a bottom side;

a front recliner frame unit, said front recliner frame unit comprising two side frame tubes, the side frame tubes of said front recliner frame unit each having a front end and a rear end, the rear ends of the side frame tubes of said front recliner frame unit being respectively slidably inserted into the front ends of the side frame tubes of said rear recliner frame unit such that said front recliner frame unit is coupled to said rear recliner frame unit and movable relative to said rear recliner frame unit between an extended position and a received position, a connecting bar transversely connected between the front ends of the side frame tubes of said front recliner frame unit, two wheel assemblies respectively pivotally mounted on the front ends of the side frame tubes of said front recliner frame unit at a bottom side, and a movable bracket pivoted to the connecting bar of said front recliner frame unit, the rear ends of the side frame tubes of said front recliner frame unit being respectively mounted with a respective retaining spring member for locking the side frame tubes of said front recliner frame unit to said rear recliner frame unit when said front recliner frame unit is moved out of said rear recliner frame unit from said received position to said extended position;

a front cushion mounted on said front recliner frame unit, said front cushion having a front side fixedly fastened to said movable bracket and a rear side freely supported on said reinforcing bar of said rear recliner frame unit; and a rear cushion fixedly fastened to the first connecting bar and second connecting bar of said rear recliner frame unit.

6. The pull-out mechanic's creeper as claimed in claim 5, wherein the side frame tubes of said front recliner frame unit each have a retaining hole near the rear end of the respective side frame tube; the side frame tubes of said rear recliner frame unit each have a retaining hole near the front end of the respective side frame tube; the retaining spring members at the rear ends of the side frame tubes of said front recliner frame unit each have a protruding retaining portion respectively projecting out of the retaining holes of the side frame tubes of said front recliner frame unit for engaging into the retaining holes of the side frame tubes of said rear recliner frame unit to lock said front recliner frame unit to said rear recliner frame unit when said front recliner frame unit is moved out of said rear recliner frame unit from said received position to said extended position.

* * * * *